US009004546B2

(12) United States Patent
Dunstan

(10) Patent No.: US 9,004,546 B2
(45) Date of Patent: Apr. 14, 2015

(54) SECURITY BOX

(75) Inventor: Brett Dunstan, Doveton (AU)

(73) Assignee: Lokaway Pty. Ltd., Doveton, Victoria (AU)

( * ) Notice: Subject to any disclaimer, the term of this patent is extended or adjusted under 35 U.S.C. 154(b) by 929 days.

(21) Appl. No.: 12/737,958

(22) PCT Filed: Sep. 2, 2009

(86) PCT No.: PCT/AU2009/001135

§ 371 (c)(1),
(2), (4) Date: Mar. 3, 2011

(87) PCT Pub. No.: WO2010/025498

PCT Pub. Date: Mar. 11, 2010

(65) Prior Publication Data

US 2011/0163109 A1 Jul. 7, 2011

(30) Foreign Application Priority Data

Sep. 3, 2008 (AU) ..... 2008904566
Oct. 17, 2008 (AU) ..... 2008905376
Jun. 10, 2009 (AU) ..... 2009902823

(51) Int. Cl.
*E05C 5/00* (2006.01)
*E05D 15/58* (2006.01)
(Continued)

(52) U.S. Cl.
CPC ..... *E05D 15/582* (2013.01); *E05F 1/1091* (2013.01); *E05G 1/026* (2013.01); *E05Y 2900/132* (2013.01); *Y10S 292/17* (2013.01)

(58) Field of Classification Search
CPC ..... E05G 1/00; E05G 1/024; E05G 1/026; E05G 1/04; E05G 2700/00; E05G 2700/02; E05D 3/06; E05D 3/12; E05D 7/14; E05D 15/56; E05D 15/58; B65D 43/20; B65D 43/22; B65D 43/16
USPC ..... 109/69–74; 220/212.5, 315, 318, 324, 220/326, 810–813, 833, 834; 49/188, 324, 49/254, 257; 312/323, 327; 292/5–8, 292/24–26, 30, 32–36, 63, 64, 109, 110, 97, 292/123, 139, 158, 196, DIG. 11, DIG. 17, 292/65, 66, 68, 69, 156, 159, 300, 302, 157, 292/116, 117; 16/366, 368, 371
See application file for complete search history.

(56) References Cited

U.S. PATENT DOCUMENTS 825,253 A 7/1906 Watson
915,397 A 3/1909 Weiss
(Continued)

FOREIGN PATENT DOCUMENTS

AU A-17475/88 8/1988
AU A-11342/95 3/1995
(Continued)

*Primary Examiner* — Kristina Fulton
*Assistant Examiner* — Alyson M Merlino
(74) *Attorney, Agent, or Firm* — D. Peter Hochberg; Sean F. Mellino

(57) ABSTRACT

A security box inter alia for tools has a metal box and a lid of the swing and slide type utilizing a pair of box hinges fixed to the box and a pair of lid hinges fixed to the lid, and a pair of intermediate hinges connected to both sets of hinges by links which make all the hinges parallel and enabling the door hinge to lie outside the plane of the door opening. In a variant, there is no intermediate hinge and the lid opening angle is less. The lid and box have interengaging profiled edges which in the closed position mutually obstruct but, when the lid slides to the open position, the profiles separate and the lid is free to swing open.

6 Claims, 7 Drawing Sheets

(51) Int. Cl.

| | |
|---|---|
| *E06B 3/36* | (2006.01) |
| *E05F 1/10* | (2006.01) |
| *E05G 1/026* | (2006.01) |

(56) References Cited

U.S. PATENT DOCUMENTS

| | | | | | |
|---|---|---|---|---|---|
| 958,624 | A | | 5/1910 | Glazier | |
| 990,469 | A | | 4/1911 | Anderson | |
| 1,873,522 | A | | 8/1932 | Abbott et al. | |
| 2,338,477 | A | * | 1/1944 | Wolters et al. | 220/812 |
| 2,936,206 | A | | 5/1960 | Wilmer et al. | |
| 3,270,462 | A | | 9/1966 | Obadal et al. | |
| 3,481,288 | A | | 12/1969 | Teleky | |
| 3,768,203 | A | * | 10/1973 | Bellucci | 49/254 |
| 3,788,689 | A | | 1/1974 | Lloyd | |
| 4,070,074 | A | | 1/1978 | Rohme | |
| 4,262,447 | A | | 4/1981 | Schneier et al. | |
| 4,294,040 | A | | 10/1981 | Crotti | |
| 4,367,684 | A | | 1/1983 | Jucker | |
| 4,372,603 | A | * | 2/1983 | Stanczak et al. | 296/146.12 |
| 4,548,330 | A | | 10/1985 | Hewitt et al. | |
| 4,679,353 | A | | 7/1987 | Langenbach et al. | |
| 4,704,970 | A | | 11/1987 | Sanderson et al. | |
| 4,712,490 | A | | 12/1987 | Lichter | |
| 4,852,503 | A | | 8/1989 | Lichter | |
| 4,932,160 | A | | 6/1990 | Sperko | |
| 5,056,262 | A | | 10/1991 | Schweiss et al. | |
| 5,223,670 | A | * | 6/1993 | Hogan et al. | 174/368 |
| 5,931,104 | A | | 8/1999 | Horn et al. | |
| 5,953,860 | A | | 9/1999 | Morgan et al. | |
| 5,971,515 | A | | 10/1999 | Baker et al. | |
| 6,161,336 | A | | 12/2000 | Ziv-Av | |
| 7,404,363 | B2 | | 7/2008 | Dunstan | |
| 7,661,375 | B2 | * | 2/2010 | McCarthy et al. | 109/74 |
| 7,735,261 | B2 | * | 6/2010 | Sellati | 49/247 |
| 7,793,600 | B2 | * | 9/2010 | Dunstan | 109/70 |
| 7,975,433 | B2 | * | 7/2011 | Dunstan | 49/254 |
| 8,171,866 | B2 | * | 5/2012 | Dunstan | 109/70 |
| 2006/0037519 | A1 | * | 2/2006 | Dunstan | 109/74 |
| 2009/0064908 | A1 | | 3/2009 | Dunstan | |
| 2010/0031857 | A1 | * | 2/2010 | Dunstan | 109/74 |

FOREIGN PATENT DOCUMENTS

| | | | | |
|---|---|---|---|---|
| AU | 2000 12438 | A1 | | 7/2000 |
| CA | 2325318 | | | 5/2002 |
| DE | 201 09 557 | U1 | | 10/2001 |
| EP | 0145079 | | | 6/1985 |
| EP | 0637674 | | | 2/1995 |
| EP | 0 670 040 | B1 | | 9/1997 |
| FR | 928 207 | | | 11/1947 |
| FR | 79 12649 | | | 12/1980 |
| FR | 2728010 | | | 6/1996 |
| WO | WO 9415055 | A1 | * | 7/1994 |
| WO | WO 96/29496 | | | 9/1996 |
| WO | WO 99/50519 | | | 10/1999 |
| WO | WO 00/79084 | A1 | | 12/2000 |
| WO | WO 01/61132 | | | 8/2001 |
| WO | WO 01/71140 | A1 | | 9/2001 |
| WO | WO 02/059528 | A1 | | 8/2002 |
| WO | WO 02/101185 | A1 | | 12/2002 |
| WO | WO 2004/033835 | | | 4/2004 |
| WO | WO 2006/094368 | | | 9/2006 |
| WO | WO 2007/006098 | | | 1/2007 |
| WO | WO 2007033428 | A1 | * | 3/2007 |
| WO | WO 2009026623 | A1 | * | 3/2009 |
| WO | WO 2010025498 | A1 | * | 3/2010 |
| WO | WO 2011011821 | A1 | * | 2/2011 |

* cited by examiner

SECURITY BOX

CROSS-REFERENCE TO RELATED APPLICATION

This is a national stage application filed under 35 USC 371 based on International Application No. PCT/AU2009/001135, filed Sep. 2, 2009, and claims priority under 35 USC 119 of Australian Patent Application No. 2008904566 filed Sep. 3, 2008, Australian Patent Application No. 2008905376 filed Oct. 17, 2008 and Australian Patent Application No. 2009902823 filed Jun. 10, 2009.

BACKGROUND OF THE INVENTION

1. Field of the Invention

This invention concerns security boxes with lids which operate using a swing and slide motion as described in the present application.

2. Description of the Prior Art

In our prior application for Patent No. PCT/AU03/001321, we describe safes with two pairs of hinges, wherein one set is mounted on the safe body and the other set is mounted on the door. The two sets of hinges are interconnected to create an offset motion whereby the door is free to both slide left and right and to swing open and closed.

The hinges are installed inside the door opening and the door width exceeds the door opening width. The swing and slide motion allows the door to slide first to clear the door opening and then to swing toward the person opening the safe giving access to the safe interior. The geometry of this arrangement permits the door to open say 90-110°.

While that application described safes and security doors, this specification is more concerned with toolboxes which are portable, lockers for vehicles such as utes, lockers for the interiors of buildings such as schools, gyms and the like and static equipment lockers for construction sites.

Such lockers must open at least through 90° to allow the contents to be accessed and stowed.

SUMMARY OF THE INVENTION

The apparatus aspect of the invention provides a security box inter alia for tools, the lid being of the swing and slide type, comprising a pair of box hinges fixed to the box interior, a pair of lid hinges fixed to the lid, and a pair of intermediate hinges connected to both the box hinges and the lid hinges by links so that hinge axes are all mutually parallel and the links allow the displacement of the door hinge to lie outside the plane of the box opening when the lid is opened through 90°.

The box opening may have a ledge and an upstand at the closing edge and the upstand acts as a landing surface for the lid.

The underside of the lid may have a projection which in the locked position underlies the box ledge and slides clear of the ledge in the unlocked position.

The box may have a ledge and a upstand at the hinge edge, the ledge providing a mounting area for the box hinges.

The lid hinges may be connected to the intermediate hinges by a first link. The box hinges may be connected to the intermediate hinges by a second link. The second link may be longer than the first link in order to give greater throw.

The second link may be a bar or angle member. This link positions the intermediate hinge substantially level with the box hinge.

The lid hinge may be connected to the underside of the lid at or near the central region of the lid.

The lid may have a downwardly facing flange along the closing edge. The depth of the flange may be somewhat less than the depth of the adjacent upstand in order to hide the upstand when viewed from the side.

The hinge edge of the upstand may have an outwardly turned flange while the hinge edge of the lid may have an inwardly turned flange which together generate a hook profile.

The lid may have a handle joined by a pivoting connector to part of the hinge assembly against which it reacts to slide the lid between the opened and closed positions. The handle may also operate a latch which can be locked by a key.

BRIEF DESCRIPTION OF THE DRAWINGS

The numerals of the main parts of this embodiment are the same as our first PCT application No. PCT/AU/2003/001321, which has matured into U.S. Pat. Nos. 7,404,363 and 7,793,600, both of which are incorporated by reference herein.

One embodiment of the invention is now described with reference to the accompanying drawings, in which.

DETAILED DESCRIPTION OF THE PREFERRED EMBODIMENTS

Figure 4:
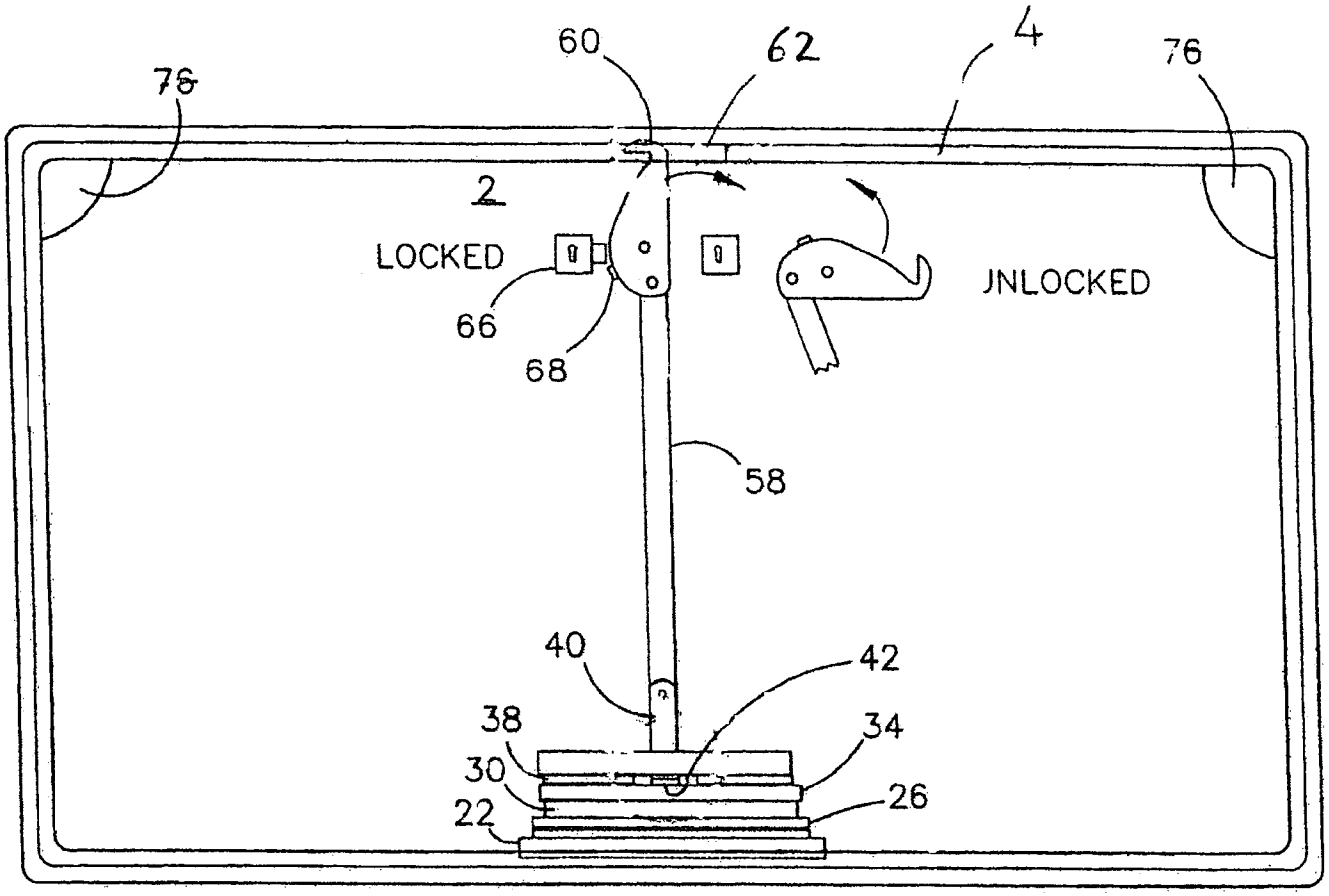
FIG. 4 is a plan of FIG. 1 with the lid shown as if it were transparent with open/closed latch positions.

Referring now to the drawings, the rectangular sheet metal toolbox 2 has a continuous peripheral upstand 4 surrounded by a continuous ledge 6. The box is closed by a lid 16. Ledge 6 acts as a landing surface for the lid when the lid opens and closes. A box hinge 22 (FIG. 4) about 300 mm long is welded to the central area of the box ledge and a hinge 26 is welded to the central area of the underside of the lid.

In FIGS. 1-4, lid hinge 26 is also connected by a short flat steel link 30 to intermediate hinge 32. This is welded to the top face of flat elongated steel link 36. Steel link 38 is of Z-section shape with a step or tongue 40 in the front edge. Tongue 40 projects through a window 42 in the link 38 in order to be connected to intermediate hinge 32.

The lid has a rotatable handle 52 which actuates a double armed lever 54. One end of the lever reacts against a reaction bar 58. Elongated link 38 transmits reaction to the box and consequently, when the handle is rotated, the only part which can move is the lid which slides to the LEFT to lock and to the RIGHT to unlock. The opposite end of the lever 54 is a hook 60 which engages a slot 62 in the upstand 4. Key operated lock 66 engages a projection 68 on the lever and arrests handle rotation.

Locking is made possible by the provision of an L-section angle 70 welded to the underside of the lid adjacent the front closing edge. The L-section angle 70 underlies ledge 6 and the edge of the lid adjacent the handle 52 is bent to form a flange 72. The opposite, rear lid edge is bent into a channel section 74. This forms a hook profile with an outwardly turned flange 76 depending from the upstand 4. Upright flange 74 moves towards and away from horizontal flange 76 around the rim of the box. Likewise flange 72 moves towards and away from the box upstand 4. A pry inserted at the front of the box will not lift the lid because L-section angle 70 meets ledge 6.

In use the toolbox resists prying because the hook profile is present at the rear and the overlying lid flange 72 at the front edge may bend upwards but the angle 70 remains beneath the ledge 6. In the locked position hook 60 engages the front wall of the box and resists prying force aimed at sliding the lid rearwardly out of engagement with the front ledge.

Figure 5:
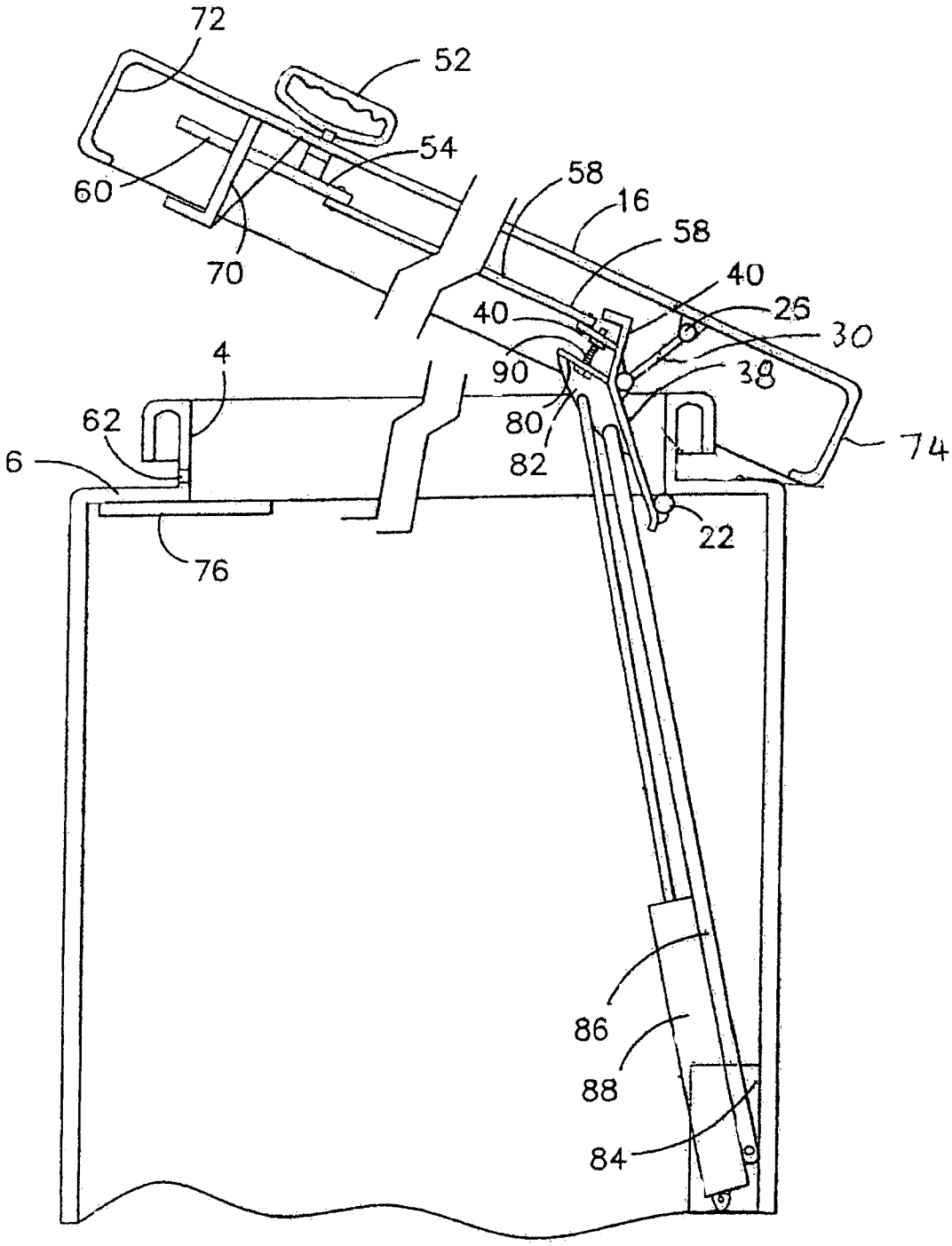
FIG. 5 is a variant of the toolbox in FIGS. 1-4, the opening of which is assisted by gas struts.

Referring now to FIG. 5, the variant has the same components as FIGS. 1-4 but in addition has a channel section bracket 74 with a web 80 joining a pair of segments 82 which in turn are welded to the undersurface of Z-link 38. Segments 82 brace web 80 and provide support. The rear wall of the box has a pair of upright flanges 84. The flanges support a pair of ties 86 which together with box hinge 22 secure the lid to the box while allowing it to open and close. In other words, flanges 84 anchor ties 86. Gas struts 88 are also connected between the flanges 84 and the segments. These assist smooth opening of the lid in known manner since gas struts 88 push up the heavy lid as soon as the lid is slid back from the LOCK position. Adjustable bolt 90 extends between web 80 and the overlying tongue 40. This permits threaded adjustment of the inclination of the lid about the axis of the box hinge 22.

During operation, Z-link 38 pivots on box hinge 22 and as Z-link 38 swings forward, flange 74 approaches the upstand 4 and underlies it when the lid 16 slides shut. The lid has a rotatable handle 52 which actuates a double armed lever 54. One end of the lever reacts against reaction bar 58 and the reaction surface is step 40. At the same time L-section angle 70 must be ready to slide under horizontal flange 76. The handle rotation pushes and pulls on step 40. The inventor found that the slide motion permitted by link 30 could be eased if adjustment by bolt 90 was made.

Figure 6:
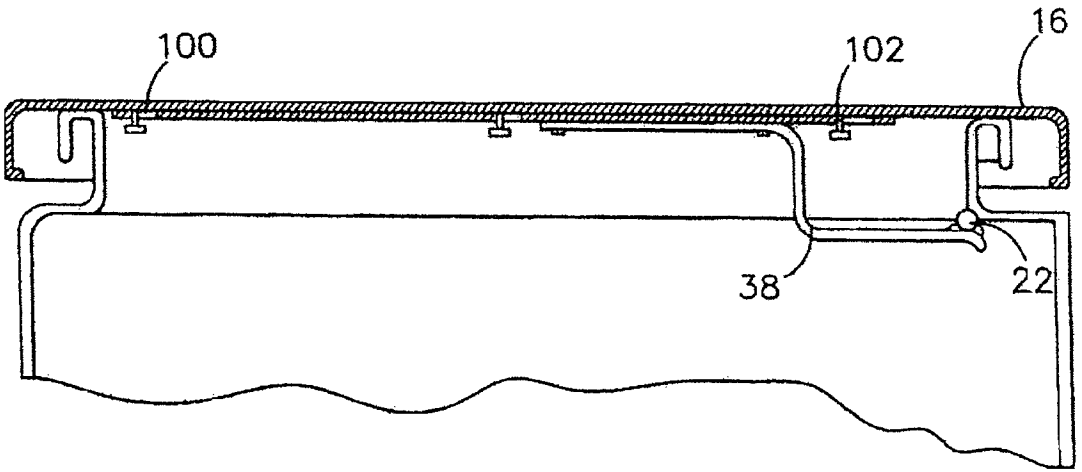
FIG. 6 is a further variant which substitutes the lid and intermediate hinges with a pin assembly on which the lid slides.

Referring now to FIG. 6, the box hinge 22 carries Z-link 38. The layer between lid 16 and Z-link 38 is E-shaped in plan as shown in our co-pending Australian Application No. 2008904078 which has now become Australian Application No. 2009203066 and corresponding to U.S. Ser. No. 12/462,917, which is incorporated by reference herein. This embodiment allows the use of a sliding lid 16 which relies on slots 100 and pins 102 instead of the triple hinge assembly of FIGS. 1-5.

Figure 7:
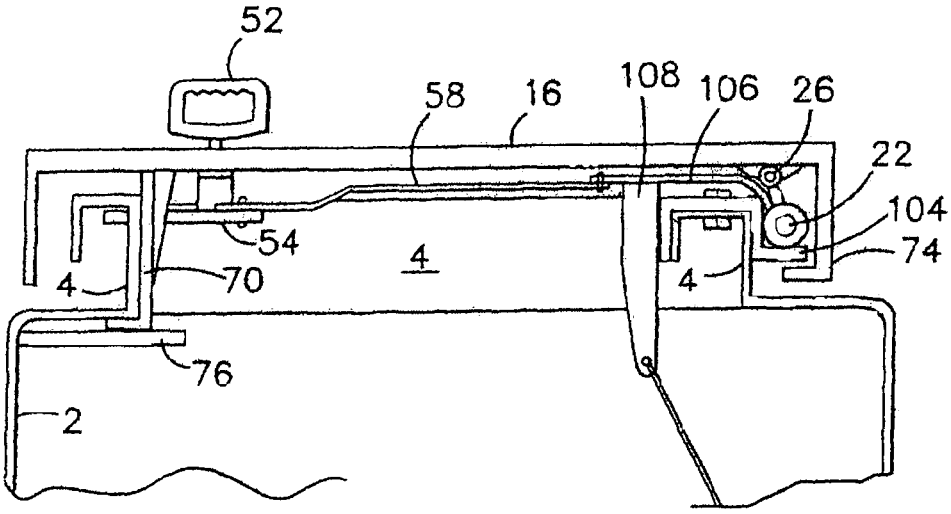
FIG. 7 is a sectional view of a box in the locked position.
Figure 8:
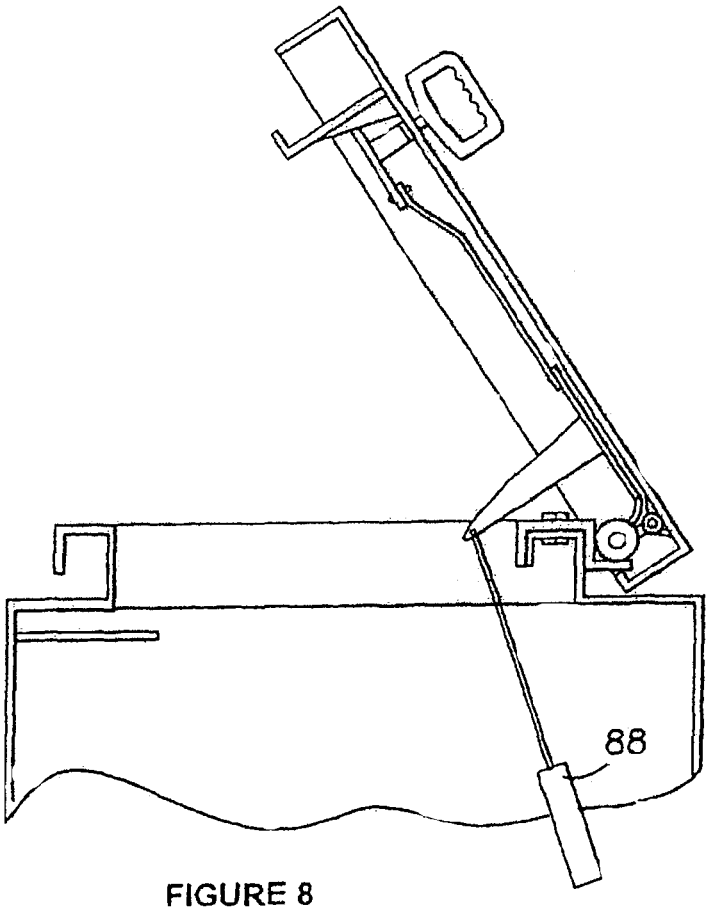
FIG. 8 is the same view as FIG. 7 but with the box unlocked and the lid open.
Figure 9:
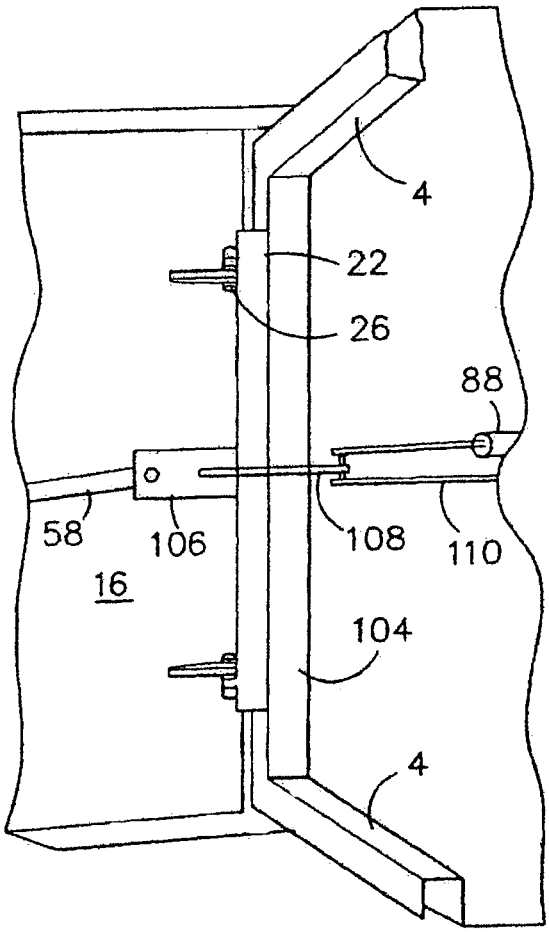
FIG. 9 is a perspective of the double hinges with the lid raised.

In FIGS. 7, 8 and 9, lid 16 is hinged differently from the embodiment in FIGS. 1-6. Lid hinges 26 are bolted to lugs welded to the lid. The box hinges 22 are welded to a channel section cap 104 fastened to the upstand 4 by bolts. The double hinge gives the required arc of sliding motion to the lid. The box hinges 22 are joined and from the central area between the hinge ends projects a bracket 106 to which reaction link or pivoting connector 58 is pivoted. Arm 108 extends from the bracket 106 in order to reach the gas strut 88 and tie 110. The key operation and latching are the same as in the embodiments of FIGS. 1-5 above.

As the door closes the L-section angle 70 contacts landing surface 76 and aligns the lid 16 which makes the final slide action precise. Flange 74 underlies cap 104 to prevent rear prying from a pry bar or other tool. Likewise L-section angle 70 underlies ledge 6 to prevent front prying.

Figure 1:
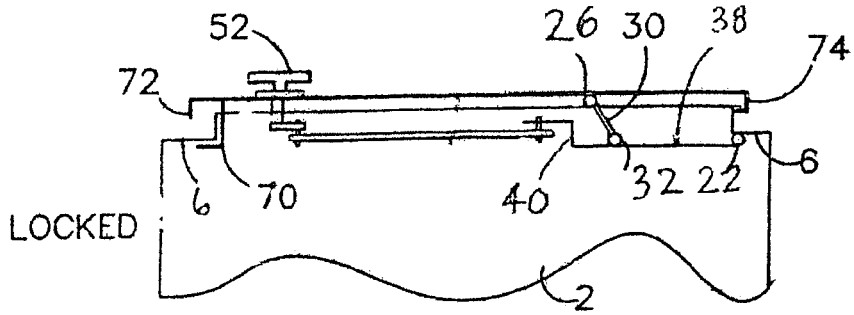
FIG. 1 is a diagrammatic side view of the lid region of a toolbox in the locked state.
Figure 2:
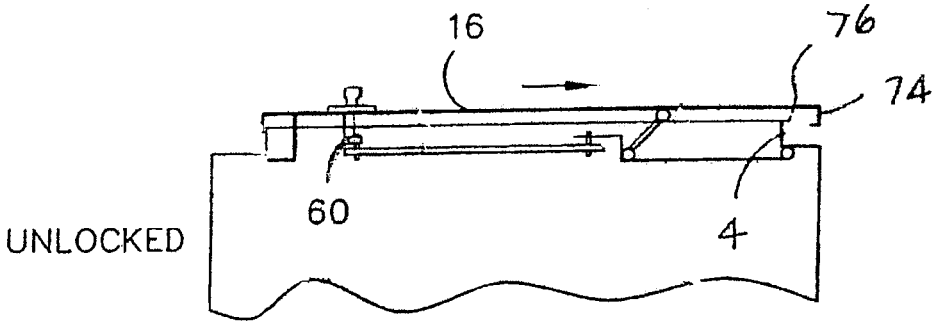
FIG. 2 is the same view as FIG. 1 with the toolbox in the unlocked state.
Figure 3:
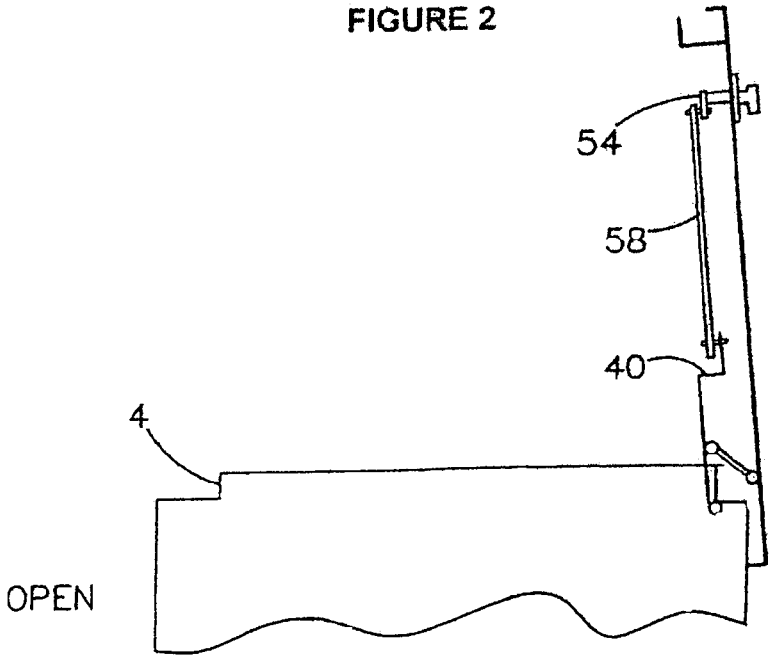
FIG. 3 is the same view as FIG. 1 with the toolbox in the unlocked state and the lid open.
Figure 10:
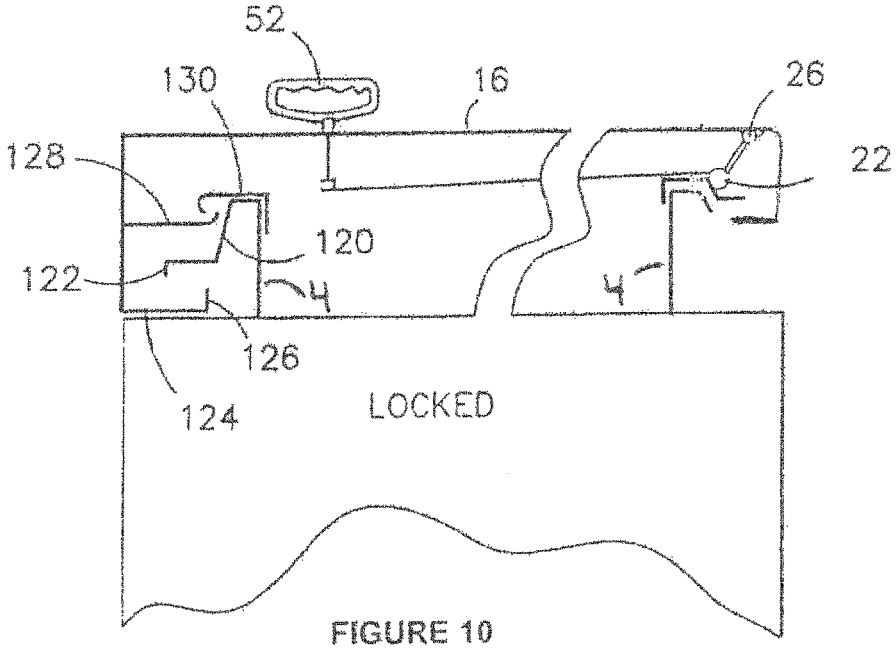
FIG. 10 is a side sectional view of a variant box in the locked position.
Figure 11:
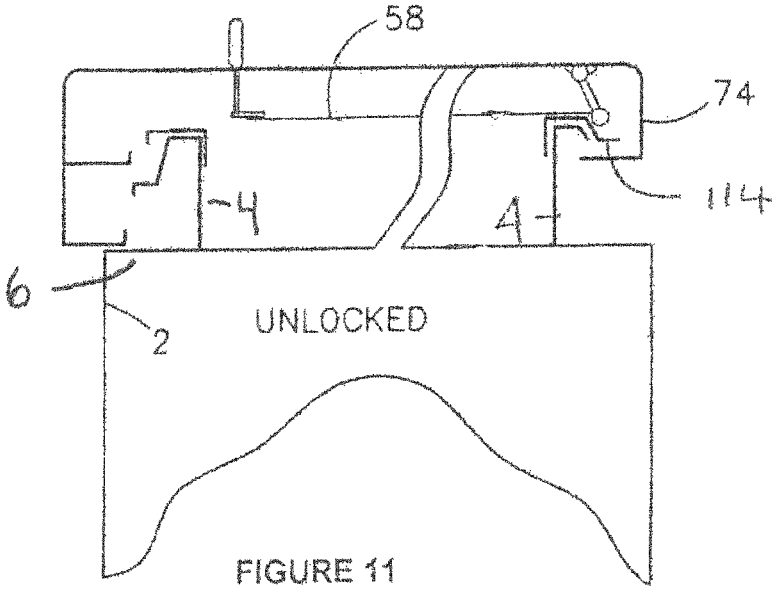
FIG. 11 is the same view as FIG. 10 with the box in the unlocked position.

Referring now to FIGS. 10 and 11, the handle 52 in this embodiment reacts against static box hinge 22 sliding the lid 16 left and right. Channel section cap 114 is fastened to upstand 4 by bolts. Channel section cap 114 is the same component as 104 in FIG. 7 and box hinge 22 is welded to channel section cap 114 as in FIG. 10. Flange 74 underlies cap 114 to prevent rear prying from a pry bar or other tool. Comparison of the lock/unlock positions of FIGS. 1-3 show that the lid movements are reversed in this embodiment, i.e. box hinge 22 remains static and the lid "floats" left and right between LOCK position shown in FIG. 10 and UNLOCK position shown in FIG. 11. In this embodiment the landing surface for the lid is the external portion of ledge 6.

At the side opposite hinge 22 the upstand 4 has an inverted lip 120 which ends in a downwardly projecting hook 122. The inwardly projecting edge of door 16 has a flange 124 which ends in upwardly projecting hook 126. This double hook construction is duplicated at flange 128 and cap 130. The twin mutual obstruction of the hook 126 with hook 122 and flange 128 with welded cap 130 defeat prying at the front of the security box.

We have found the advantages of the above embodiment to be:

1. Good degree of access to the interior.
2. Hinges are internal and inaccessible.
3. Pry resistant construction because the hooks and flanges which withstand the prying forces extend along the full length of one side of the box. The box and lid are mutually supportive in resisting entry.

It is to be understood that the word "comprising" as used throughout the specification is to be interpreted in its inclusive form, i.e. use of the word "comprising" does not exclude the addition of other elements.

It is to be understood that various modifications of and/or additions to the invention can be made without departing from the basic nature of the invention. Holes can be provided in the floor or walls of the box for passage of bolts to secure the box to the site or vehicle. These modifications and/or additions are therefore considered to fall within the scope of the invention.

The claims defining the invention are as follows:

1. A security box having a fully closed state and a fully open state, said security box comprising:
   - a lid having:
     - an interior surface,
     - an exterior surface,
     - a closing edge,
     - a hinge edge, and
     - a closing edge flange located at said closing edge, said closing edge flange having a hook profile terminating in a hook directed toward the interior surface of said lid,
     - wherein said lid is slidably movable in a slide motion between an open position and a closed position;
   - a box having:
     - an opening,
     - a closing edge upstand located proximal said closing edge of said lid, said closing edge upstand having a hook profile,
     - a hinge edge upstand located proximal said hinge edge of said lid, and
     - a ledge surrounding said closing edge upstand and said hinge edge upstand;

at least one box hinge operatively attached to said hinge edge upstand;

at least one lid hinge operatively attached to the interior surface of the hinge edge of said lid, said at least one lid hinge and said at least one box hinge being mutually attachable to form an offset hinge assembly;

a closing edge capping member operatively attached to said closing edge upstand, said closing edge capping member further comprising a hook profile; and a second hook profile located on said closing edge flange of said lid;

wherein when said lid slides into the closed position the respective hook profiles are engageable for mutually obstructing said lid from rotating open, and when said lid slides into the open position the hook profile of said closing edge flange clears the hook profile of said closing edge upstand allowing said lid to rotate open about said at least one box hinge; and wherein when said lid slides into the closed position, said hook profile of said closing edge capping member and said second hook profile are engageable for mutually obstructing said lid from opening.

2. A security box as claimed in claim 1 further comprising a hinge edge capping member removably attached to said hinge edge upstand, said at least one box hinge being operatively attached to said hinge edge capping member.

3. A security box as claimed in claim 2, wherein said lid further comprises a hinge edge flange located at the hinge edge proximal said hinge edge capping member, said hinge edge flange having a hook profile configured to underlie said hinge edge capping member when the lid is in the closed position for rendering said at least one box hinge inaccessible.

4. A security box as claimed in claim 1 further comprising:

a rotatable handle on the exterior surface of said lid; and a link operatively connected to said handle and to said at least one box hinge, said link reacting against said at least one box hinge for sliding said lid between the closed position and the open position.

5. A security box as claimed in claim 1, said lid further comprising a hinge edge flange located at said hinge edge, said hinge edge flange being proximal said at least one box hinge and having a hook profile configured to underlie said at least one box hinge for rendering said at least one box hinge inaccessible in the closed position.

6. A security box as claimed in claim 1, wherein:

said closing edge upstand and said hinge edge upstand are positioned opposite said interior surface of said lid for limiting access to said respective upstands when said lid is in the closed position; and wherein said ledge surrounding said closing edge upstand is configured as a landing surface for said closing edge flange for enabling the slidable movement of said lid between the closed position and the open position.

* * * * *